United States Patent [19]

Hermans

[11] Patent Number: 4,874,962

[45] Date of Patent: Oct. 17, 1989

[54] LOW POWER, LEAKAGE CURRENT SWITCHING CIRCUIT

[76] Inventor: Albert L. Hermans, 2555 Nicholson St., San Leandro, Calif. 94577

[21] Appl. No.: 52,482

[22] Filed: May 21, 1987

[51] Int. Cl.[4] ..... H01H 47/12

[52] U.S. Cl. ..... 307/116; 361/179

[58] Field of Search ..... 361/178, 170, 179, 173, 361/175, 181; 340/693, 600; 307/116, 117, 118

[56] References Cited

U.S. PATENT DOCUMENTS 4,169,982 10/1979 Rittmann ..... 361/181

*Primary Examiner*—L. T. Hix
*Assistant Examiner*—David M. Gray
*Attorney, Agent, or Firm*—Harris Zimmerman; Howard Cohen

[57] ABSTRACT

A low power switching circuit for delivering electrical power to a load includes a rectifier network connected between the hot leg of the AC utility supply and the earth ground of the utility supply. A neon lamp interposed in the rectifier supply limits the current drawn through the rectifier to less than the 500 μa code limit for current flow to ground. A high sensitivity, dual coil, bistable relay is connected between the hot leg of the AC supply and the load, which is connected to the neutral leg of the same supply. A capacitor network is connected to the DC output of the rectifier to store sufficient power to operate the relay, and a transistor switching network is connected to deliver the power from the capacitor network to the relay upon receipt of a trigger signal. A "smart" switch such as an area occupancy sensor may be connected to the transistor switching network to provide the trigger signal to cause the relay to switch AC power to the load.

21 Claims, 2 Drawing Sheets

LOW POWER, LEAKAGE CURRENT SWITCHING CIRCUIT

BACKGROUND OF THE INVENTION

In existing lighting an HVAC systems, the circuit powering these systems are commonly controlled by wall switches placed in easily accessible locations, such as adjacent to doorways, and the like. Insitutions, businesses, offices, and commercial establishments have found that a great deal of power is consumed to light and ventilate rooms and areas that are unoccupied for relatively long periods. Thus it is preferred for energy conservation reasons, as well as security purposes, that these systems be turned on automatically when a room is entered and that these systems be definitely turned off a short time after the room is completely vacated. To fill this need, occupancy sensors utilizing ultrasonic sensors, ambient noise sensors, infrared sensors, and the like have been developed in the prior art to detect human presence in a room and to switch on and off the relatively large loads comprises of lighting and HVAC circuits.

With regard to converting a typical wall light switch to automatic operation by installation of an occupancy sensor in the wall switch box, it first must be noted that generally only two wires are fed into the wall switch box: the hot leg feed from the utility power supply to the switch, and the wire extending from the switch to the load. Generally, the other side of the load is connected directly to the neutral leg of the AC power supply without returning to the switch box. Thus the switch box is provided with a hot leg to supply the occupancy sensor, but there is no neutral leg to connect to the sensor to complete in the circuit to the sensor. Extending a third wire from AC neutral to the wall box is an extremely costly and time consuming task, due to the fact that wall and/or ceiling surfaces will need to be breached and reclosed, in non-conduit systems, and the wire may need to be pulled through existing conduit.

In this setting, a conventional circuit employing a transformer and switching relay cannot be used, due to the fact that a transformer requires connection between the hot and neutral legs of the AC utility power supply. Indeed, the only common type of switching system that can be used is an electronic switching circuit comprised of a triac and/or diac device. However, the triac and diac devices create electronic noise and also generate radio frequency interference which can be detrimental to the sensitive communications and computer equipment now used in many office and commericial buildings. In addition, these devices are unstable, due to the surge currents and voltages as high as 10,000 volts which occur in electrical systems. These surges can destroy the triac and diac devices. Furthermore, these devices are constantly drawing current and creating heat, whether or not the load is switched on. Many consumers are not favorably disposed towards an electrical system which maintains the wall switch box in a state of perpetual heating that is clearly palpable to the touch.

SUMMARY OF THE PRESENT INVENTION

The present invention generally comprises an electrical load switching system that is adapted to be used in existing (or new) electrical lighting and HVAC systems without requiring connection to the neutral leg of the AC utility power system. A salient feature of the invention is that it eliminates triac or diac devices to effect load switching, thus eliminating a source of RFI and heat generation. Another important feature of the invention is that it is powered by connection between the hot leg of the AC utility power supply and the earth ground generally connected to the wall switch box itself.

The low power switching circuit delivering electrical power to a load includes a rectifier network connected between the hot leg of the AC utility supply and the earth ground of the utility supply. A neon lamp interposed in the rectifier supply limits the current drawn through the rectifier to less than the 500 $\mu$a code limit for current flow to ground. A high sensitivity, dual coil, bistable relay is connected between the hot leg of the AC supply and the load, which is connected to the neutral leg of the same supply. A capacitor network is connected to the DC output of the rectifier to store sufficient power to operate the relay, and a transistor switching network is connected to deliver the power from the capacitor network to the relay upon receipt of a trigger signal. A "smart" switch such as an area occupancy sensor may be connected to the transistor switching network to provide the trigger signal to cause the relay to switch AC power to the load.

DESCRIPTION OF THE PREFERRED EMBODIMENT

Figure 1:
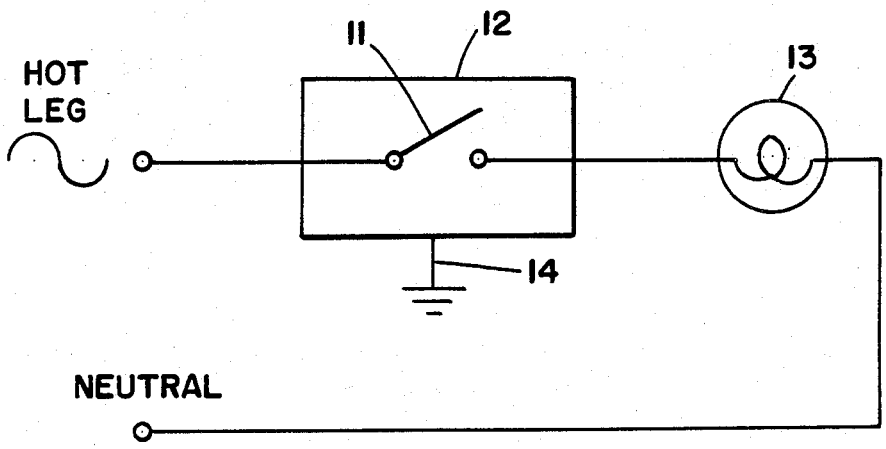
FIG 1 ( PRIOR ART )
FIG. 1 is a block diagram of a typical building lighting circuit known in the prior art.

The present invention generally comprises a low power switching circuit that is adapted to be used to switch loads such as building lighting circuits and HVAC circuits. With regard to FIG. 1, a typical load circuit known in the prior art and installed in millions of buildings includes a normally open switch 11 disposed in a junction box or wall box 12. One side of the switch 11 is connected to the hot leg of the AC utility power supply, and the normally open contact of the switch is connected to the load 13, which may comprise one or more lighting fixtures or the like. The fixtures comprising the load 13 are connected thence to the neutral leg of the AC utility supply, generally consisting of the center tap connection of the utility power transformer. In addition, most electrical systems include an earth ground connection 14 to the wall box containing the switch 11, both for safety considerations and to satisfy electrical code requirements.

To make prudent use of increasingly expensive electrical power, many consumers are installing "smart" switches to shut off power to the load 13 when there is no human presence in the area illuminated or ventilated by the devices comprising the load 13. This modification requires the replacement of the switch 11 by a device which senses human presence within the defined area, and controls power to the load in response to signal from the sensor.

Figure 2:
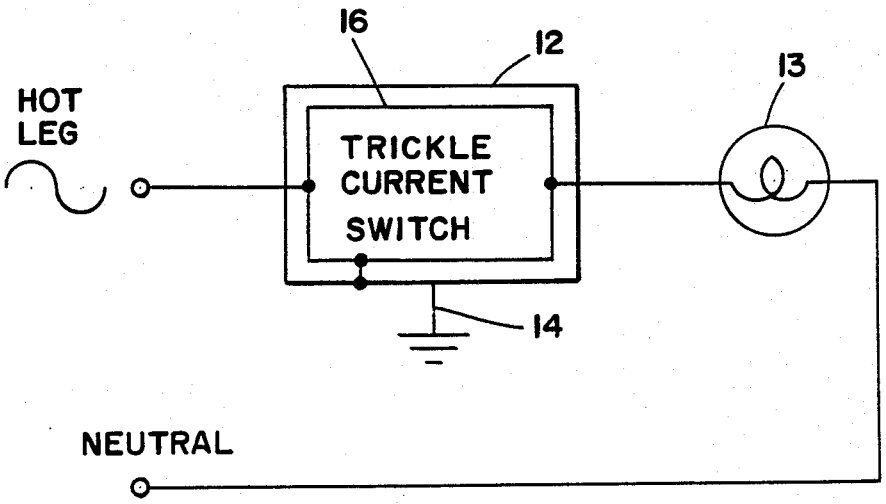
FIG. 2 is a block diagram of a typical building lighting circuit as in FIG. 1, modified with the addition of the low power switching circuit of the present invention.

In the present invention, shown in block diagram form in FIG. 2, the switch 11 is replaced by the low power switching circuit 16 driven by trickle current in a circuit extending from the hot leg of the AC power to the earth ground of the wall switch box. That is, the circuit 16 is connected intentionally to earth ground to complete the circuit path that drives the switching circuit. The switching circuit then selectively feeds the line extending to the load 13, as will be explained in the following description. The present invention is particularly adapted to utilize the earth ground connection, due to the fact that it is designed to draw less current than is permitted by building and underwriters codes to flow to earth ground.

Figure 3:
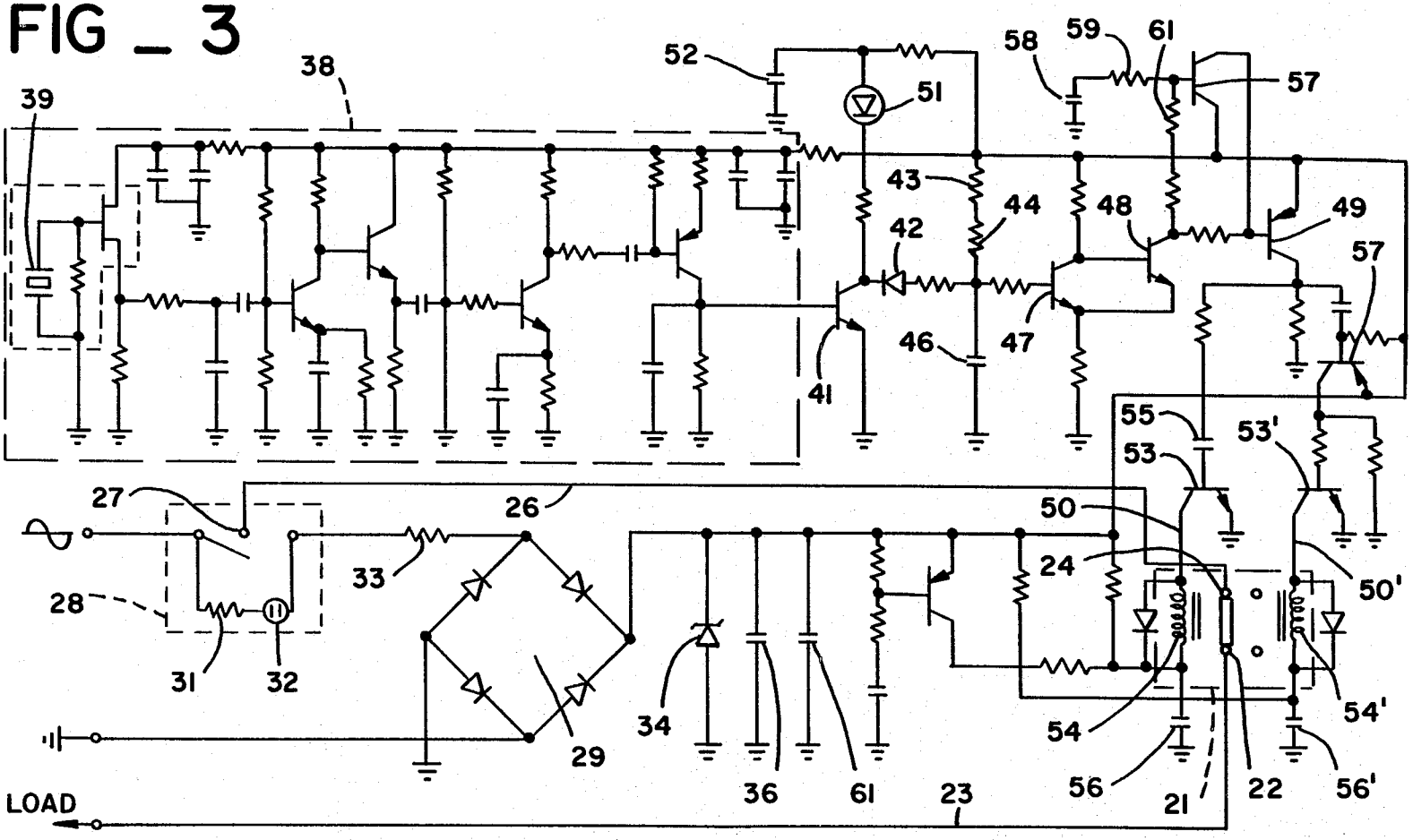
FIG. 3 is a schematic diagram of the circuit of the low power switching circuit of the present invention.

With regard to FIG. 3, the curcuit of the present invention features a high sensitivity, double coil, bistable switching relay 21 to preform the task of switching power to the load circuit. One example of such a relay, available from Aromat Corporation, Mountainside, N.J., can handle loads drawing up to 8 amps at 250 VAC, yet requires less than 200 mW of power to effect switching. A further salient feature of this type of relay is that it latches in the on or off state, and draws no power except when undergoing switching. One set of contacts is used to control the load, a contact 22 being connected through line 23 to load, and the paired contact 24 being connected through line 26 to normally open contact 27 of manual power switch 28. The input to the switch 28 is the hot leg of the AC power supply.

The DC power supply of the present invention includes a bridge rectifier 29 connected at one end through a series combination of resistor 31, neon lamp 32, and resistor 33 to the hot leg of the AC utility power supply. The other end of the rectifier 29 is connected directly to the earth ground connection in the wall switch box, such as the conduit or switch box itself, or the earth ground wire extending thereto. The resistors 31 and 33 together with the neon lamp 32 limit the current to the rectifier to less than 500 $\mu$a, the general limit set by underwriter codes for current leakage to earth ground in building wiring systems. The output of the rectifier is approximately 10 volts, regulated by Zener diode 34 and smoothed by capacitor 36, and the other DC side of the rectifier comprises circuit ground for the invention. This DC system operates all of the circuitry of the invention.

A key feature of the present invention is the provision of a human presence, or occupany sensor circuit 38, which is adapted to detect the proximity of at least one person and to generate an actuating signal in response. The sensor circuit 38 utilizes an infrared detector 39 to sense the radiated heat from nearby persons. Such devices are known in the prior art, and the circuit 38 is shown by way of example only. Other devices, utilizing ambient noise detection, ultrasonic motion detection, and the like, may also be used effectively. The sensor circuit 38 is driven by the DC power supply 29, and it responds to human presence by providing a signal to the base of transistor 41 to drive that transistor into conduction.

The collector of transistor 41 is connected through isolating diode 42 to an RC timing network comprised of resistors 43 and 44 and capacitor 46, which in turn is connected to the base of transistor 47. The valves of these components are chosen so that capacitor 46 requires between 10 and 20 minutes to change sufficiently to switch transistor 47. Thus the RC timing network establishes the "on" period for the switching circuit, as will be explained in the following; whenever the occupancy sensor produces a signal to the base of transistor 41 to turn on that transistor, the capacitor 46 is discharged through transistor 41 to circuit ground. The timing network is thus reset, and capacitor 46 begins to recharge.

Also connected to the collector of transistor 41 is an LED 51, driven by a power storage capacitor 52. The LED is illuminated whenever transistor 41 is switched on by the occupancy signal to provide visual indication of operation of the detector, and for "walk test" purposes. The capacitor 52 requires approximately 10 seconds to recharge between LED actuations.

Transistor 47 is connected in cascade fashion to transistors 48 and 49 to be switched on and off thereby. The output of transistor 49 is connected to two branching circuits. One of the branches comprises transistor 53, one of the relay coils 54, and power storage reservoir capacitor 56. The other branch includes like componets (indicated by the same reference numeral with a (') indication), and in addition an inverter stage comprised of transistor 57. Thus as transistor 49 is switched on and off by transistor 47, the two circuit branches 50 and 50' will be actuated alternately to drive the respective coil of the switching relay. When transistor 49 is driven into conduction, the resulting signal spike coupled through capacitor 55 triggers transistor 53 into conduction, discharging capacitor 56 through coil 54 to ground and switching the relay to connect AC power to the load.

The power storage reservoir capacitors 56 and 56', together with large storage capacitor 61, are a significant feature of the present invention; they store the power required by the relay coils to effect switching of the AC load thereby. These capacitors, which require approximately 1–10 seconds to charge fully, permit operation of the relay even though the steady state power flowing into the circuit is limited by network 31–33 to less than 500 $\mu$a to meet code restrictions. It may be appreciated that as either branch is actuated, current will flow from the respective capacitor 56 or 56' through the relay coil 54 or 54', through transistor 53 or 53' and thence to circuit ground, thus effecting actuation of the relay and switching of the load.

The present invention further includes a disabling network which permits the capacitors 56 and 56' to charge fully before the circuit can operate. Transistor 57 is connected between the base and emitter of transistor 49, and RC timing network comprised of capacitor 58 and resistors 59 and 61 is connected to the base of transistor 57. This RC network charges to set point potential in approximately 1–10 seconds, during which time the system is disabled by virtue of the choke potential applied to the base of transistor 49. When the RC network 58–61 is charged, transistor 57 is switched thereby, and the system begins to operate. This feature is important during initial startup of the system, and after power failures and the like.

When the present invention is installed in a switch box, the existing switch plate is removed and replaced by the outer casing of the invention, so that the infrared detector 39 is directed toward the area to be served by the load circuit and so that the LED 51 is visible to anyone in the general area. In addition, the neon lamp 32, which is constantly illuminated, is also visible, and it indicates the location of the device in darkness. The manual power switch 28 is also available to be actuated at the wall switch box, and the neon lamp indicates its location.

When the invention is installed either as a replacement for an existing wall switch or as original equipment, the wire 23 extending to the electrical load is connected to one terminal, the hot leg of the AC utility supply is connected to the other terminal, and the device itself is connected to the earth ground of the wall box or the ground wire present in the switch box. The neon lamp indicates operation of the circuit, but the system is disabled for approximately 1–10 seconds while capacitors 56 and 56' are charged to full potential. After capacitor 58 charges and transistor 57 is switched out, the system is fully operational. Thereafter, any human presence in the area of the switch box will turn on transistor 41, illuminating LED 51 and actuating transistor 47. Transistor 49 is thus actuated to operated branch 50 and coil 54 to switch AC utility power through line 23 to the load, such as the area lighting fixtures. When no human presence is detected for 10–20 minutes, RC network 43, 44, and 46 charges sufficiently to turn off transistors 47 and 49. As transistor 49 goes off, the inverter stage 57 actuates circuit branch 50' and relay coil 54' to open the relay contacts and interrupt AC power to the load.

I claim:

1. A low power switching circuit for delivering AC electrical power to a load from a AC power supply having a hot leg, a neutral leg and earth ground connections, including full wave rectifier means connected between the hot leg and the earth ground connection, current limiting means connected between the hot leg and said rectifier means to restrict current flow to said rectifier means to less than 500 microamps, relay means having normally open contacts, means for connecting one of said normally open contacts to the hot leg and the other of said normally open contacts to said load, transistor switching circuit means for operating said relay means in response to an actuating signal, said transistor switching circuit and said relay means being connected to said rectifier means and driven solely by the direct current therefrom, and sensor means for generating said actuating signal in response to human presence proximate to said low power switching circuit.

2. The low power switching circuit of claim 1, wherein said relay means comprises a low power, bistable latching relay.

3. The low power switching circuit of claim 2, further including storage capacitor reservoir means connected to said rectifier means for storing sufficient electrical power to actuate said latching relay.

4. A low power switching circuit for delivering AC electrical power to a load from a grounded wiring system of an AC power supply having a hot leg, neutral leg and earth ground connections, including rectifier means connected between the hot leg and the earth ground connection, current limiting means connected between the hot leg and said rectifier means to restrict current flow to said rectifier means, relay means having normally open contacts, said relay means comprising a low power, bistable latching relay, means for connecting one of said normally open contacts to the hot leg and the other of said normally open contacts to said load, transistor switching circuit means for operating said relay means in response to an acturating signal, sensor means for generating said actuating signal in response to human presence proximate to said low power switching circuit, storage capacitor reservoir means connected to said rectifier means for storing sufficient electrical power to actuate said latching relay, and disabling circuit means for disabling said transistor switching circuit means during charging of said storage capacitor reservoir means.

5. The low power switching circuit of claim 4, wherein said latching relay comprises a dual coil latching relay, and said storage capacitor reservoir means includes a pair of storage capacitors, each connected to one side of each of said coils of said latching relay.

6. The low power switching circuit of claim 5, wherein said transistor switching circuit means includes transistor means connected to the other side of each of said coils of said latching relay to selectively connect the stored power of the respective storage capacitor through the respective coil to effect actuation of the relay switching of said contacts.

7. A low power switching circuit for delivering AC electrical power to a load from a grounded wiring system of an AC power supply having a hot leg, neutral leg and earth ground connections, including rectifier means connected between the hot leg and the earth ground connection, current limiting means connected between the hot leg and said rectifier means to restrict current flow to said rectifier means, relay means having normally open contacts, means for connecting one of said normally open contacts to the hot leg and the other of said normally open contacts to said load; transistor switching circuit means for operating said relay means in response to an actuating signal, and sensor means for generating said actuating signal in response to human presence proximate to said low power switching circuit, said rectifier means including a rectifier having a pair of AC terminals and a pair of DC terminals, said current limiting means including a neon lamp and a current limiting resistor connected between said hot leg and one of said AC terminals, one of said DC terminals comprising the DC power source and the other of said DC terminals comprising the DC ground for said transistor switching means, said relay means, and said sensor means.

8. The low power switching circuit of claim 7, wherein the other of said AC terminals is connected to said earth ground connection.

9. The low power switching circuit of claim 1, wherein said sensor means comprises an infrared sensing device and operating circuit for detecting infrared emissions from human beings proximate to said sensing device, said infrared device operating circuit generating said actuating signal upon detection of human presence.

10. The low power switching circuit of claim 8, wherein said transistor switching circuit means includes a first transistor having a base connected to said sensor means, and a first RC timing network connected to the emitter-collector circuit of said first transistor, whereby said first RC timing network is connected to said circuit ground and discharged by actuation of said first transistor by said actuating signal.

11. The low power switching circuit of claim 10, including a second transistor having a base connected to said first RC timing network, said second transistor having an emitter-collector circuit biased to be switched into conduction by charging of said first RC timing network to a preselected voltage over a predetermined period of time.

12. The low power switching circuit of claim 11, further including a pair of branch circuits connected through third transistor means to the emitter-collector circuit of said second transistor and adapted to be switched alternately thereby, each of said pair of branch circuits being connected to deliver power to one of a pair of coils of a dual coil latching relay comprising said relay means.

13. The low power switching of circuit of claim 12, wherein each of said branching circuits includes one of a pair of storage capacitors for storing sufficient power to operate said coils of said relay.

14. The low power switching circuit of claim 13, further including an LED connected to said emitter-collector circuit of said first transistor to indicate reception of said actuating signal.

15. The low power switching circuit of claim 14, further including second RC timing network means connected to said LED to provide operating power for said LED.

16. The low power switching circuit of claim 13, further including disabling circuit means connected to said third transistor means, said disabling circuit means including a third RC timing network and means for inhibiting operation of said branching circuits during charging of said third RC timing network to provide sufficient time for said storage capacitors to be fully charged.

17. A low power switching circuit adapted for use in a grounded wiring system supplied with one circuit leg connected to AC utility power, a second circuit leg connected to a load, and an earth-ground connection, including rectifier means connected to the earth-grounded connection, current limiting means connected between said one circuit leg and said rectifier means to restrict current flow to said rectifier means and to the earth-grounded connection, relay means operatively connected between said one circuit leg and said second circuit leg for selectively connecting AC utility power to the load, switching circuit means for operating said relay means in response to an actuating signal, and sensor means for generating said actuating signal in response to human presence proximate to said low power switching circuit, said rectifier means operatively connected to power said switching circuit means, said sensor means, and said relay means.

18. The low power switching circuit of claim 17, wherein the current flow through said current limiting means is insufficient to directly operate said relay means, and further including storage capacitor reservoir means connected to said relay means for storing sufficient power to operate said relay means.

19. A low power switching circuit adapted for use in a a grounded wiring system supplied with one circuit leg connected to AC utility power and another circuit leg connected to a load, and an earth ground connection, including; rectifier means connected to the earth-grounded connection, current limiting means connected between said one circuit leg and said rectifier means to restrict current flow to said rectifier means and to the earth-ground connection, relay means operatively connected between said one circuit leg and said another circuit leg for selectively connecting AC utility power to the load, switching circuit means for operating said relay means in response to an actuating signal, and sensor means for generating said actuating signal in response to human presence proximate to said low power switching circuit, said rectifier means operatively connected to power said switching circuit means, said sensor means, and said relay means, said low power switching circuit means being free of any connection to said another circuit leg.

20. A low power switching circuit adapted for use in a grounded wiring system supplied with a hot first circuit leg connected to supply AC utility power, a second circuit leg connected as a return leg for AC utility power, and a third circuit leg connected to earth ground, said switching circuit including a pair of power connection terminals connected to said first circuit leg and to said earth-grounded third circuit leg, said switching circuit being free of any connection to said second circuit leg, said switching circuit further including current limiting means to restrict current flow to said earth-grounded third circuit leg to a safe level for a grounded wiring system, relay means operatively connected between said first circuit leg and a load, and switching circuit means for operating said relay means in response to an actuating signal.

21. The low power switching circuit of claim 20, wherein the current flow through said current limiting means is insufficient to directly operate said relay means, and further including storage capacitor reservoir means connected to said relay means for storing sufficient power to operate said relay means.

* * * * *

US004874962B1

REEXAMINATION CERTIFICATE (2521st)

United States Patent [19]

Hermans

[11] B1 4,874,962

[45] Certificate Issued Apr. 4, 1995

[54] LOW POWER, LEAKAGE CURRENT SWITCHING CIRCUIT

[76] Inventor: Albert L. Hermans, 2555 Nicholson St., San Leandro, Calif. 94577

Reexamination Request:
No. 90/003,308, Nov. 26, 1993

Reexamination Certificate for:

| | |
|---|---|
| Patent No.: | **4,874,962** |
| Issued: | **Oct. 17, 1989** |
| Appl. No.: | **52,482** |
| Filed: | **May 21, 1987** |

[51] Int. Cl.[6] ..... H01H 47/12
[52] U.S. Cl. ..... 307/116; 361/179
[58] Field of Search ..... 307/116; 361/179

[56] References Cited

U.S. PATENT DOCUMENTS

| | | | |
|---|---|---|---|
| 4,169,982 | 10/1979 | Rittmann | 361/181 |
| 4,340,826 | 7/1982 | Muchnick | 307/157 |
| 4,346,427 | 8/1982 | Blissett et al. | 361/173 |
| 4,527,216 | 7/1985 | Stammely | 361/156 |
| 4,618,770 | 10/1986 | Maile | 250/338 |

*Primary Examiner*—David M. Gray

[57] ABSTRACT

A low power switching circuit for delivering electrical power to a load includes a rectifier network connected between the hot leg of the AC utility supply and the earth ground of the utility supply. A neon lamp interposed in the rectifier supply limits the current drawn through the rectifier to less than the 500 μa code limit for current flow to ground. A high sensitivity, dual coil, bistable relay is connected between the hot leg of the AC supply and the load, which is connected to the neutral leg of the same supply. A capacitor network is connected to the DC output of the rectifier to store sufficient power to operate the relay, and a transistor switching network is connected to deliver the power from the capacitor network to the relay upon receipt of a trigger signal. A "smart" switch such as an area occupancy sensor may be connected to the transistor switching network to provide the trigger signal to cause the relay to switch AC power to the load.

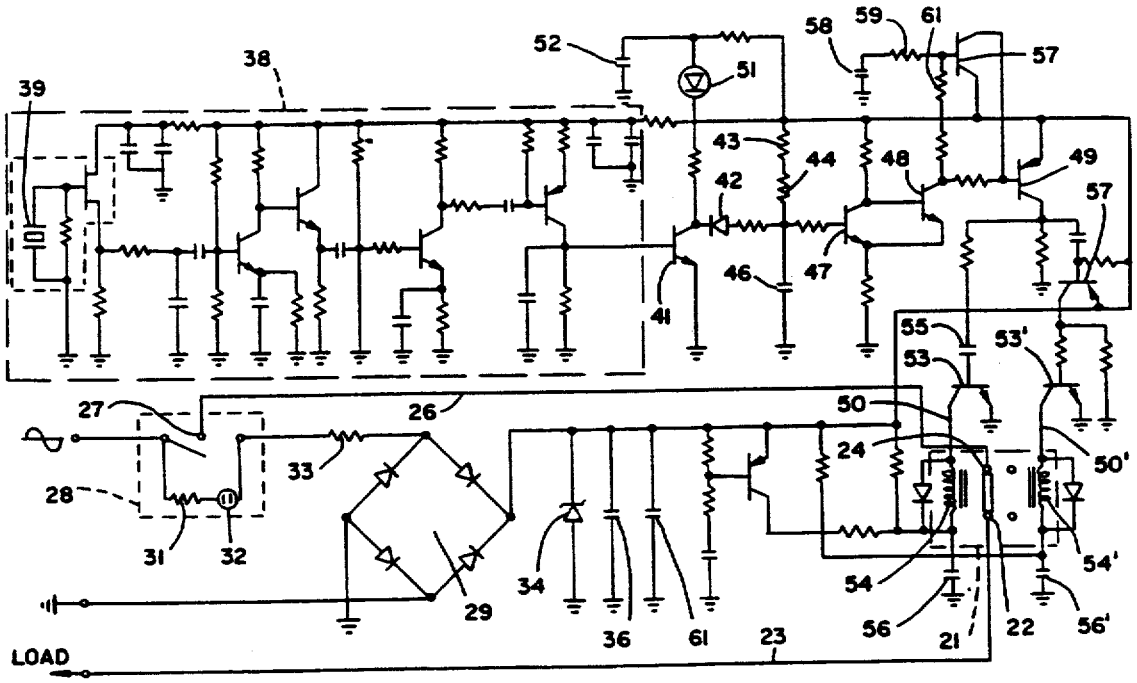

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 7, 17, 19 and 20 are determined to be patentable as amended.

Claims 2, 3, 5, 6, 8–16, 18 and 21, dependent on an amended claim, are determined to be patentable.

1. A low power switching circuit for delivering electrical power to a load from a AC power supply having a hot leg, a neutral leg and earth ground connections, including full wave rectifier means connected between the hot leg and the earth ground connection *and which conducts current from said hot leg to said earth ground connection including during periods when said switching circuit is in the open condition and is not delivering power to said load*, current limiting means connected between the hot leg and said rectifier means to restrict current flow to said rectifier means to less than 500 microamps, *latching* relay means having normally open contacts, means for connecting one of said normally open contacts to the hot leg and the other of said normally open contacts to said load, transistor switching circuit means for operating said relay means in response to an actuating signal, said transistor switching circuit and said relay means being connected to said rectifier means and driven solely by the direct current therefrom, and sensor means for generating said actuating signal in response to human presence proximate to said low power switching circuit.

4. A low power switching circuit for delivering AC electrical power to a load from a grounded wiring system of an AC power supply having a hot leg, neutral leg and earth ground connections, including rectifier means connected between the hot leg and the earth ground connection *and which conducts current from said hot leg to said earth ground connection including during periods when said switching circuit is in the open condition and is not delivering power to said load*, current limiting means connected between the hot leg and said rectifier means to restrict current flow to said rectifier means, *latching* relay means having normally open contacts, said relay means comprising a low power, bistable latching relay, means for connecting one of said normally open contacts to the hot leg and the other of said normally open contacts to said load, transistor switching circuit means for operating said relay means in response to an [acturating] *actuating* signal, sensor means for generating said actuating signal in response to human presence proximate to said low power switching circuit, storage capacitor reservoir means connected to said rectifier means for storing sufficient electrical power to actuate said latching relay, and disabling circuit means for disabling said transistor switching circuit means during charging of said storage capacitor reservoir means.

7. A low power switching circuit for delivering AC electrical power to a load from a grounded wiring system of an AC power supply having a hot leg, neutral leg and earth ground connections, including rectifier means connected between the hot leg and the earth ground connection *and which conducts current from said hot leg to said earth ground connection including during periods when said switching circuit is in the open condition and is not delivering power to said load*, current limiting means connected between the hot leg and said rectifier means to restrict current flow to said rectifier means, *latching* relay means having normally open contacts, means for connecting one of said normally open contacts to the hot leg and the other of said normally open contacts to said load, transistor switching circuit means for operating said relay means in response to an actuating signal, and sensor means for generating said actuating signal in response to human presence proximate to said low power switching circuit, said rectifier means including a rectifier having a pair of AC terminals and a pair of DC terminals, said current limiting means including a neon lamp and a current limiting resistor connected between said hot leg and one of said AC terminals, one of said DC terminals comprising the DC power source and the other of said DC terminals comprising the DC ground for said transistor switching means, said relay means and said sensor means.

17. A low power switching circuit adapted for use in a grounded wiring systrem supplied with one circuit leg connected to AC utility power, a second circuit leg connected to a load and an earth-ground connection, including rectifier means connected to the earth-grounded connection *and which conducts current from said one circuit leg to said earth ground connection including during periods when said switching circuit is in the open condition and is not delivering power to said load*, current limiting means connected between said one circuit leg and said rectifier means to restrict current flow to said rectifier means and to the earth-grounded connection, *latching* relay means operatively connected between said one circuit leg and said second circuit leg for selectively connecting AC utility power to the load, switching circuit means for operating said relay means in response to an actuating signal, and sensor means for generating said actuating signaling response to human presence proximate to said low power switching circuit, said rectifier means operatively connected to power said switching circuit means, said sensor means and said relay means.

19. A low power switching circuit adapted for use in a grounded wiring system supplied with one circuit leg connected to AC utility power and another circuit leg connected to a load, and an earth ground connection, including: rectifier means connected to the earth-grounded connection *and which conducts current from said one circuit leg to said earth ground connection including during periods when said switching circuit is in the open condition and is not delivering power to said load*, current limiting means connected between said one circuit leg and said rectifier means to restrict current flow to said rectifier means and to the earth ground-connection, *latching* relay means operatively connected between said one circuit leg and said another circuit leg for selectively connecting AC utility power to the load, switching circuit means for operating said relay means in response to an actuating signal, and sensor means for generating said actuating signal in response to human presence proximate to said low power switching circuit, said rectifier means operatively connected to power said switching circuit means, said sensor means, and said relay means, said low power switching circuit means being free of any connection to said another circuit leg.

20. A low power switching circuit adapted for use in a grounded wiring system supplied with a hot first circuit leg connected to supply AC utility power, a second circuit leg connected as a return leg for AC utility power, and a third circuit leg connected to earth ground, said switching circuit including a pair of power connection terminals connected to said first circuit leg and to said earth-grounded third circuit leg *and which remain connected thereto during periods when said switching circuit is in the open condition and is not delivering current to said second circuit leg*, said switching circuit being free of any connection to said second circuit leg, said switching circuit further including current limiting means to restrict current flow to said earth-grounded third circuit leg to a safe level for a grounded wiring system, relay means operatively connected between said first circuit leg and a load, and switching circuit means for operating said relay means in response to an actuating signal.

* * * * *